US006361383B1

(12) United States Patent
Ko

(10) Patent No.: US 6,361,383 B1
(45) Date of Patent: Mar. 26, 2002

(54) CABLE END CONNECTOR RELIABLY POSITIONING A SHELL

(75) Inventor: David Tso-Chin Ko, Thousand Oaks, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/797,135

(22) Filed: Feb. 28, 2001

(51) Int. Cl.[7] ..... H01R 13/11
(52) U.S. Cl. ..... 439/856; 439/582; 439/585
(58) Field of Search ..... 439/578, 582, 439/581, 585, 607–610, 63, 854, 855, 856

(56) References Cited

U.S. PATENT DOCUMENTS 4,799,900 A * 1/1989 Capp et al. ..... 439/585
5,772,470 A * 6/1998 Tsgashe ..... 439/582
5,879,190 A * 3/1999 Maruyama et al. ..... 439/582
6,099,350 A * 8/2000 Wright ..... 439/582

* cited by examiner

*Primary Examiner*—Hien Vu
(74) *Attorney, Agent, or Firm*—Wei Te Chung

(57) ABSTRACT

A cable end connector includes a dielectric housing (10), a terminal (30) received in the housing, a shell (50) shielding the housing, and a retainer (60) attached to the shell for holding a coaxial cable (70) therein. The housing includes a tubular portion (20) and a base portion (40) engaged with the tubular portion. The tubular portion forms three enlarged mounting legs (23) respectively fitted in three cutouts (431) of the base portion. The shell has a trunk portion (51) and an inner periphery of the trunk portion interferentially engages with the enlarged mounting legs, thereby tightly attaching the shell on the housing. A pair of arms (513) rearwardly extend from the trunk portion for accommodating a tail portion (31) of the terminal therebetween.

5 Claims, 7 Drawing Sheets

CABLE END CONNECTOR RELIABLY POSITIONING A SHELL

FIELD OF THE INVENTION

The present invention generally relates to a cable end connector, and more particularly to a cable end connector accurately and reliably positioning a shell thereof.

BACKGROUND OF THE INVENTION

Cable end connector are often used for transmitting Radio-frequency (RF) signals. The cable end connectors normally have a terminal received in a housing thereof to mate with a complementary plug. Such a conventional cable end connector is, for example, disclosed in U.S. Pat. No. 5,263,877. The cable end connector includes a dielectric member holding a central terminal within an outer conductive shell. The central terminal has a U-shaped connection portion for connecting with a coaxial cable and a coupling portion for mating with a complementary plug. As disclosed in this patent, in assembly, an upper side wall of the dielectric member and a holder portion of the outer shell are bent substantially at a right-angle to hold the connection portion of the terminal and an inner conductor of the coaxial cable within the dielectric member and to crimp the coaxial cable braiding to the connector outer shell. A projection of the holder portion crimps the dielectric member and a pair of wing portions are bent in rectangular cross section, thereby connecting the shell with the dielectric member.

However, since the wing portions are bent to enclose the shell, it is difficult to control the bending degree of the wing portions for tightly enclosing the dielectric member. An undesirable movement between the shell and the dielectric member is likely to occur after the connector is completely assembled.

Hence, an improved connector for accurately and firmly positioning a shell is required to overcome the disadvantages of the prior art.

The copending application Ser. No. 09/709,226 filed Nov. 8, 2001 with the same inventor and the same assignee, discloses an approach to replace the design of U.S. Pat. No. 5,263,877, and the instant application specifically focuses on the retention structures in the housing and between the housing and the shell.

BRIEF SUMMARY OF THE INVENTION

A main object of the present invention is to provide a cable end connector accurately positioning a shell around a housing thereof and reliably mating with a complementary connector.

A cable end connector according to the present invention comprises a dielectric housing, a terminal received in the housing, a unitarily formed shell, and a retainer attached to the shell for holding a coaxial cable therein.

The housing includes a base portion and a tubular portion engaged with the base portion. The base portion defines three cutouts, and the tubular portion forms three enlarged mounting legs fitted in the cutouts. The tubular portion axially defines a passageway therethrough. The terminal has a mating portion and a tail portion substantially perpendicularly to each other. The mating portion extends into the passageway for electrically mating with a complementary connector. The tail portion is retained on the base portion for connecting with an inner conductor of the coaxial cable. The shell includes a planar portion supporting the housing, and a trunk portion connected to the planar portion and interferentially fitting with the enlaged mounting legs of tubular portion of the housing, thereby tightly connecting the shell with the housing. A pair of arms rearwardly extend from the trunk portion. The arms and a portion of the retainer define a space for accommodating the tail portion of the terminal.

Other objects, advantages and novel feather of the invention will become more apparent from the following detailed description when taken in conjunction with the accompanying drawings.

DETAILED DESCRIPTION OF THE INVENTION

Figure 6:
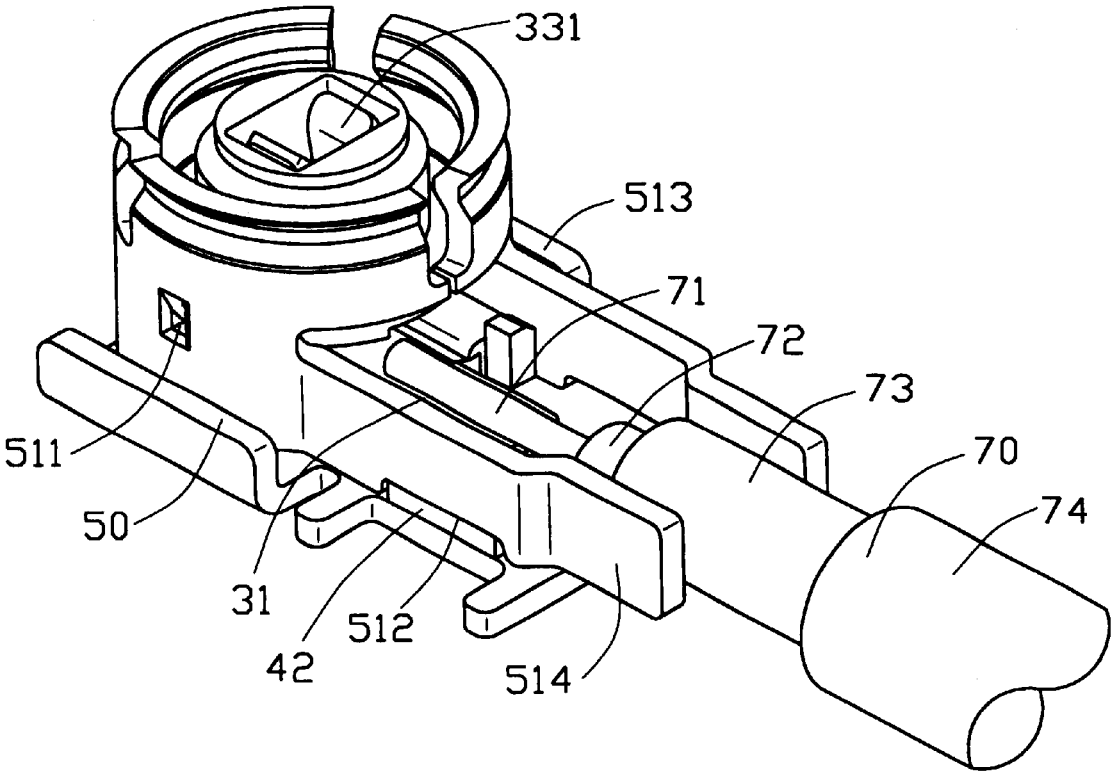
FIG. 6 is a perspective view of a cable end connector assembly according to the present invention without a retainer.
Figure 7:
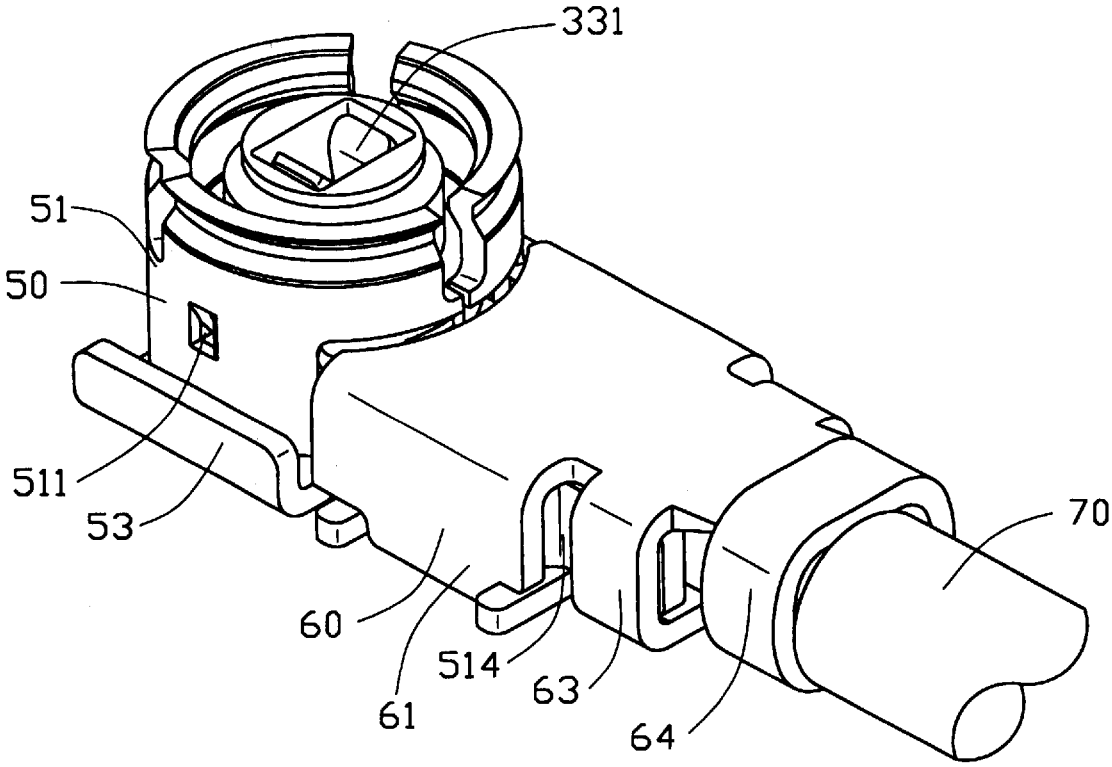
FIG. 7 is perspective view of the cable end connector assembly with the retainer.

Referring to the drawings and particularly to FIGS. 6 and 7, a cable end connector in accordance with the present invention comprises a dielectric housing 10, a terminal 30 received in the housing 10, a metallic shell 50 shielding the housing 10, and a retainer 60 for securing an end portion of a coaxial cable 70.

Figure 1:
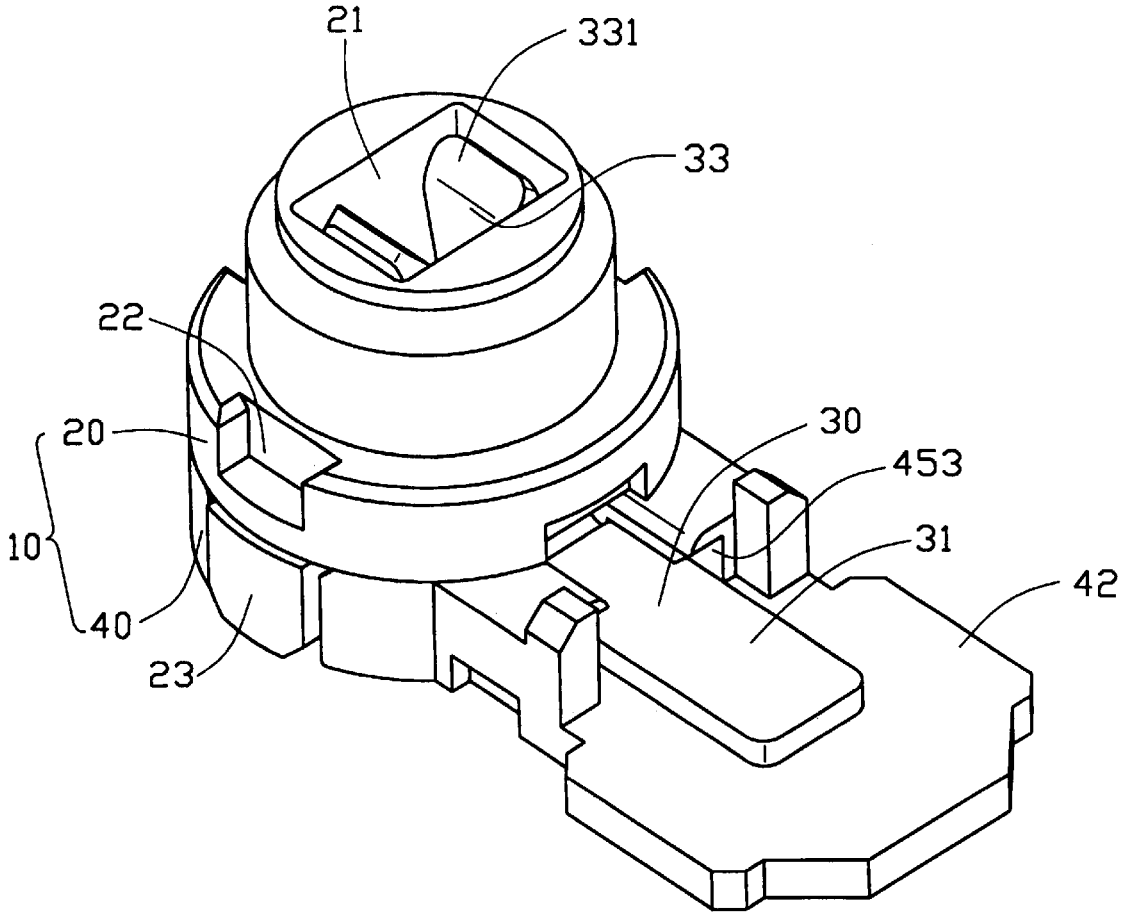
FIG. 1 is a perspective view of a housing and a terminal of a cable end connector according to the present invention.
Figure 2:
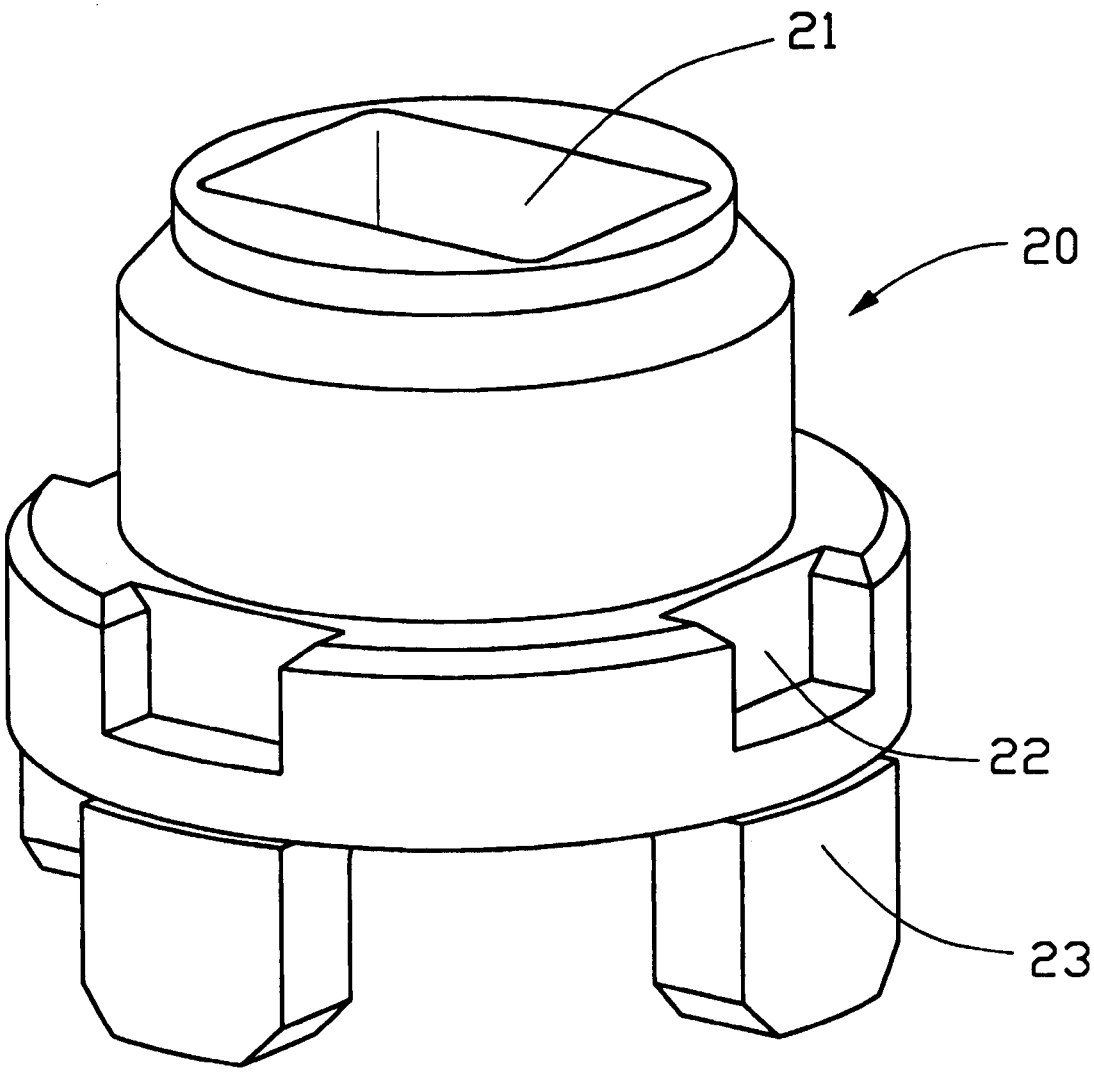
FIG. 2 is a perspective view of a tubular portion of the housing.
Figure 3:
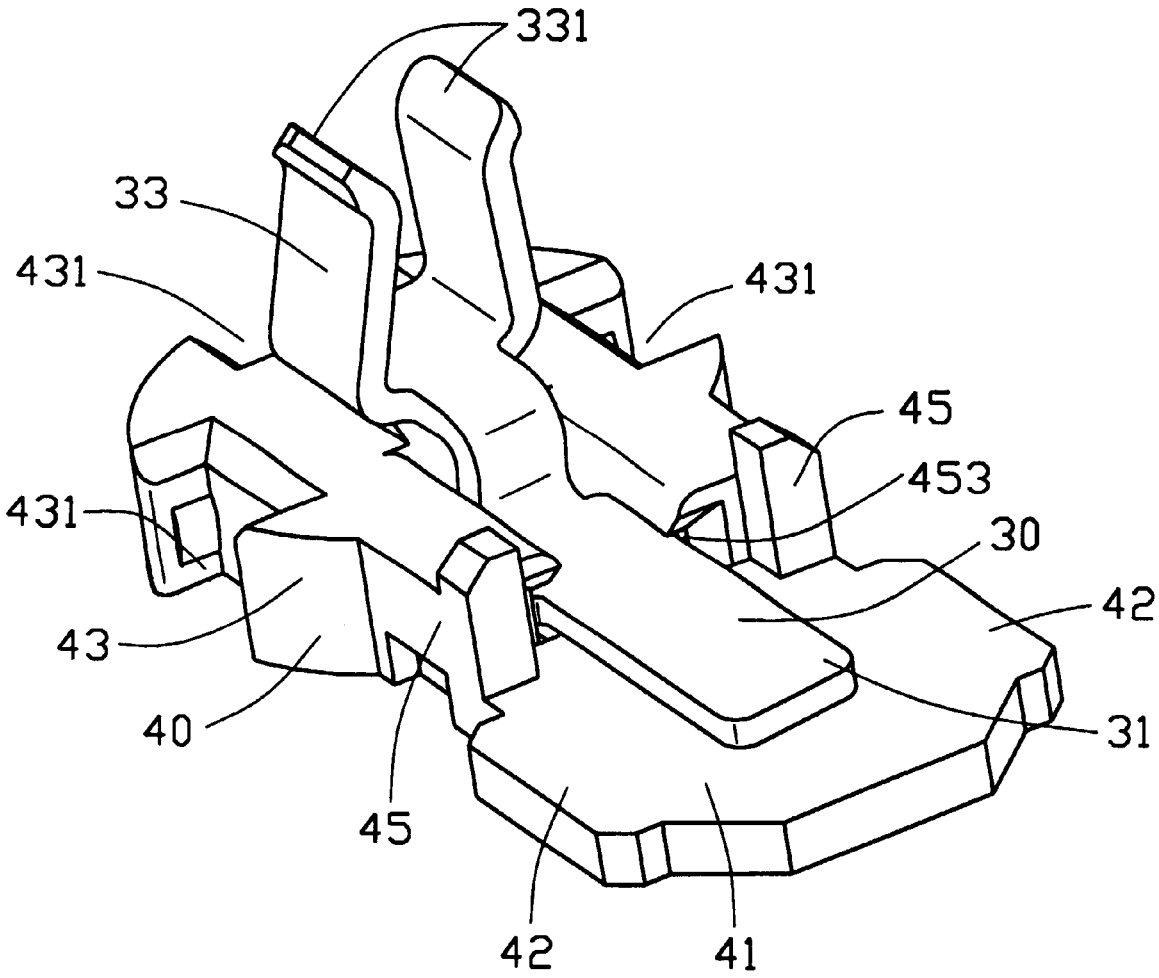
FIG. 3 is a perspective view of a base portion of the housing with the terminal.

Referring to FIGS. 1, 2 and 3, the dielectric housing 10 comprises a vertical tubular portion 20 and a base portion 40 for engaging with the tubular portion 20. The tubular portion 20 defines three recesses 22 angularly disposed in an outer periphery thereof and a substantially rectangular passageway 21 axially therethrough. Three mounting legs 23 depend from a bottom of the tubular portion 20 for locking with the base portion 40. The mounting legs 23 are enlarged in dimension for a tight engagement with the metallic shell 50.

The base portion 40 comprises a cylindrical engaging block 43 and a flat portion 41 extending rearwardly from the engaging block 43. A pair of retaining walls 45 project along opposite front sides of the flat portion 41. A pair of positioning wings 42 are respectively formed on opposite rear sides of the flat portion 41. A pair of grooves 453 are respectively defined in an inward lower corner of each retaining wall 45 opposing to each other. Three cutouts 431 are distributed in an outer periphery of the engaging block 43 and dimensioned for retaining the mounting legs 23.

Referring to FIG. 3, the terminal 30 is substantially L-shaped and includes a mating portion 33 and a planar tail portion 31 substantially perpendicular to each other. The mating portion 33 is bifurcated and including a pair of beams 331 substantially projecting toward each other for mating with a complementary connector (not shown).

Figure 4:
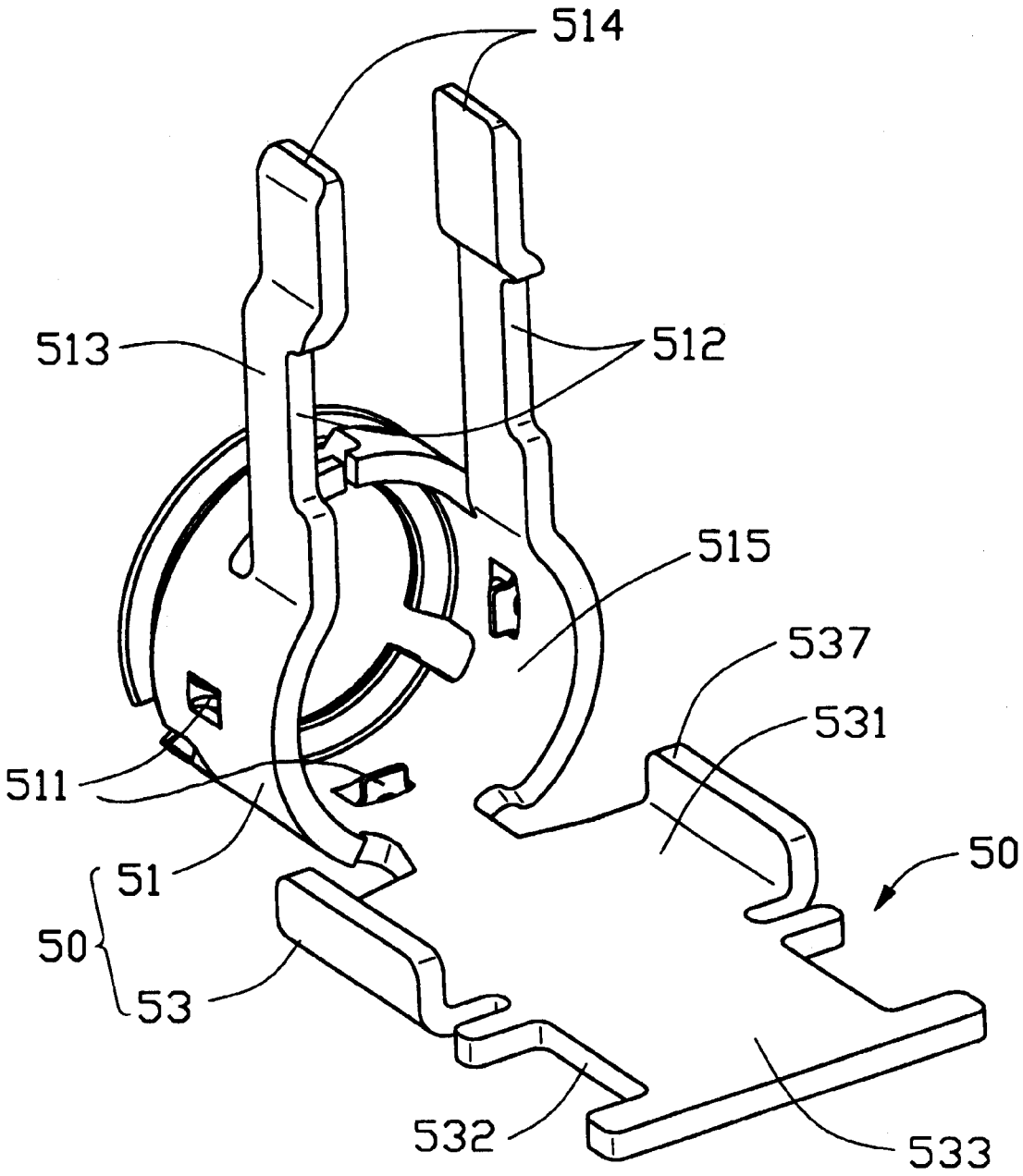
FIG. 4 is a perspective view of a shell of the cable end connector wherein the shell is unbent.

Referring to FIG. 4, the shell 50 is unitarily formed and comprises a cylindrical trunk portion 51 and a planar portion 53 connected to the trunk portion 51. The trunk portion 51 is substantially cylindrical and has a pair of arms 513 rearwardly extending from a lower portion thereof. Each arm 513 defines a notch 512 in a lower end portion thereof. A sealing tab 514 extends rearwardly from a distal end of each arm 513 and protrudes inwardly slightly. The trunk portion 51 defines a hollow portion 515 therethrough for enclosing the tubular portion 20 of the housing 10. Three hooks 511 are formed on an inner periphery of the trunk portion 51, e.g. at 90 degrees interval.

The planar portion 53 has a front portion 531 for supporting the trunk portion 51, and a rear portion 533 rearwardly extending from the front portion 531 for supporting the arms 513 and the housing 10. The front portion 531 forms a pair of side walls 537 in opposite sides thereof for fitting with the outer periphery of the trunk portion 51. The rear portion 533 defines a pair of elongated indentations 532 in opposite sides thereof.

Figure 5:
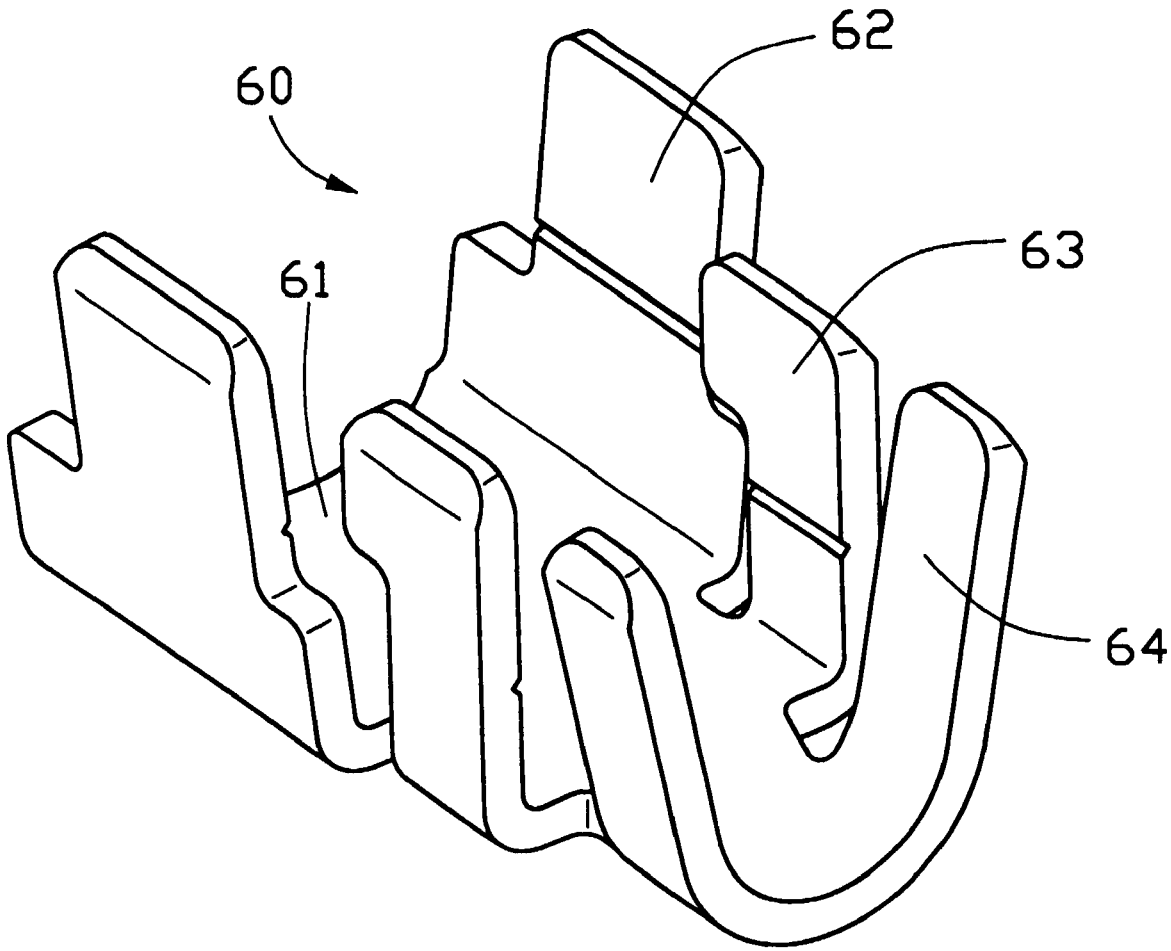
FIG. 5 is a perspective view of a retainer of the cable end connector.

With reference to FIG. 5, the retainer 60 is conductive and comprises a body portion 61, a braiding crimp 63 rearwardly extending from a rear end of the body portion 61 for grounding a braiding layer 73 of the coaxial cable 70 (see FIG. 7), and a strain relief 64 rearwardly extending from the braiding crimp 63 for securely clamping the coaxial cable 70. A pair of locking tabs 62 respectively project upwardly from opposite sides of the body portion 61.

Referring to FIGS. 6 and 7, the coaxial cable 70 includes an inner conductor 71, a braiding layer 73, an inner insulator 72 separating the inner conductor and the braiding layer 73 and an outer insulator 74 surrounding the braiding layer 73.

Referring to FIGS. 1, 6 and 7, a cable end connector assembly is assembled as follows:

(1) The terminal 30 is inserted forwardly from a rear end of the base portion 40 of the housing 10. The tail portion 31 of the terminal 30 is partially retained in the grooves 453 and partially disposed on the flat portion 41 of the base portion 40.

(2) The tubular portion 20 of the housing 10 is mounted onto the base portion 40. The mating portion 33 of the terminal 30 extends into the passageway 21 of the tubular portion 20, the beams 331 of the mating portion 33 abutting against corresponding inner walls (not labeled) of the passageway 21.

(3) An inner conductor 71 of the coaxial cable 70 is soldered onto the tail portion 31 of the terminal 30.

(4) The trunk portion 51 of the shell 50 is brought to encircle the housing 10. The hooks 511 of the trunk 51 interferentially engage with the recesses 22. The inner periphery of the trunk portion 51 tightly engages with the enlarged mounting legs 23 of the tubular portion 20. The arms 513 accommodate the flat portion 41 of the housing 10 therebetween with the notch 512 thereof engaging with the positioning wing 42.

(5) The planar portion 53 is bent toward the trunk portion 51 until the planar portion 53 completely abuts a bottom of the housing 10.

(6) Each of the locking tabs 63 of the retainer 60 engages with a corresponding indentation 532 of the planar portion 53 and is bent, thereby fixedly retaining the arms 513 to an upper face of the planar portion 53. The tail portion 31 of the terminal 30 is therefore surrounded by both the arms 513 and the body portion 61 of the retainer 60 but without contacting either. The braiding crimp 63 of the retainer 60 encloses a part of the sealing tabs 514 of the trunk portion 51 for securely clamping the braiding layer 73 of the coaxial cable 70. The outer insulator 74 of the coaxial cable 70 is firmly retained in the strain relief 64 of the retainer 60.

It is to be understood, however, that even though numerous, characteristics and advantages of the present invention have been set forth in the foregoing description, together with details of the structure and function of the invention, the disclosed is illustrative only, and changes may be make in detail, especially in matters of shape, size, and arrangement of parts within the principles of the invention to the full extent indicated by the broad general meaning of the terms in which the appended claims are expressed.

What is claimed is:

1. A cable end connector for electrically connecting with a cable, comprising:

a dielectric housing including a base portion defining cutouts in an outer periphery thereof, and a tubular portion having enlarged mounting legs fitted in said cutouts;

a terminal positioned in the housing;

a conductive shell including a trunk portion and a planar portion connected to the trunk portion, the trunk portion interferentially enclosing the enlarged mounting legs of the tubular portion; and a retainer covering the planar portion and adapted to hold a coaxial cable therein; wherein the tubular portion of the housing defines recesses in an outer periphery thereof, and the bunk portion of the shell forms hooks on an inner periphery thereof for engaging with said recesses, respectively; wherein the base portion of the housing includes an engaging block and a flat portion extending rearwardly from the engaging block, the flat portion including a pair of the positioning wings projecting laterally from opposite sides thereof, and wherein the trunk portion of the shell includes a pair of arms extending from a lower portion thereof, each arm defining a notch for receiving a corresponding positioning wing; wherein the planar portion of the shell is bent to support the trunk portion.

2. The cable end connector according to claim 1, wherein the planar portion of the shell defines a pair of elongated indentations in opposite sides thereof, and the retainer forms a pair of locking tabs fitted in the indentations respectively.

3. The cable end connector according to claim 1, wherein the retainer is attached to said planar portion of the shell for retaining said arms to said flat portion.

4. The cable end connector according to claim 1, wherein the base portion defines a pair of grooves in opposite lower corners thereof, and wherein the terminal forms a tail portion partially retained in the grooves.

5. A cable end connector assembly comprising:

a dielectric housing including a plate-like base portion defining a plurality of cutouts along an outer periphery thereof, and a tubular portion forming a plurality of legs on a bottom portion thereof to fit within the corresponding cutout without rotation;

a terminal positioned within the housing;

a conductive shell including a trunk portion surrounding the tubular portion and having arms extending therefrom, and a planar portion abutting against a first face of said base portion opposite to said tubular portion;

a retainer covering said planar portion and said arms and secured to a second face of the base portion opposite to said first face, said retainer cooperating with the base portion defining a space to receive a coaxial cable therein; and means for pressing the tubular portion against the base portion so as to secure the housing and the shell together; wherein said means includes hooks formed on the shell engaged within corresponding recesses of the tubular portion so as to restrict rotative and linear movements of the tubular portion relative to the trunk portion.

* * * * *